United States Patent [19]

Beierwaltes

[11] 3,944,763

[45] Mar. 16, 1976

[54] SWIMMING POOL TOUCH PAD

[76] Inventor: Richard R. Beierwaltes, 513 N. 4th Ave., Maywood, Ill. 60153

[22] Filed: Nov. 1, 1974

[21] Appl. No.: 519,869

[52] U.S. Cl. ..... 200/52 R; 200/86 R; 200/264; 272/4; 340/323 R

[51] Int. Cl.[2] H01H 3/02; H01H 35/00; A63K 3/00; G07C 1/22

[58] Field of Search .... 200/52 R, 85 R, 86 R, 86 A, 200/243, 275, 264, 265; 272/4; 340/273, 272, 323

[56] References Cited

UNITED STATES PATENTS

| | | | |
|---|---|---|---|
| 3,230,325 | 1/1966 | Parkinson | 200/86 R X |
| 3,522,398 | 7/1970 | Heimann | 272/4 UX |
| 3,544,989 | 12/1970 | MacCreadie | 340/323 |
| 3,584,169 | 6/1971 | Leu | 200/85 R |
| 3,590,181 | 6/1971 | Baran | 272/4 UX |
| 3,678,496 | 7/1972 | Stalp | 272/4 |
| 3,699,294 | 10/1972 | Sudduth | 200/264 X |
| 3,745,275 | 7/1973 | Degiez | 200/86 R X |
| 3,784,768 | 1/1974 | Hunt | 200/86 R X |

*Primary Examiner*—James R. Scott
*Attorney, Agent, or Firm*—Silverman & Cass, Ltd.

[57] ABSTRACT

A swimming pool touch pad seats on a swimming pool wall and is adapted to close an external electric circuit when contacted by a swimmer. The pad includes a nonconductive baseplate adapted to be mounted on a swimming pool wall. A normally nonconductive generally planar pressure sensitive elastomeric pad is seated on the baseplate and is adapted to become selectively conductive through the pad from the front to the rear surface upon application of pressure by a swimmer. When conductive it will provide an electrical current path in the area of pressure application. Electrodes secured to the front and rear surfaces of the elastomeric pad and insulated conductors connected between the electrodes and the external circuit complete the electrical path from the elastomeric pad to the external circuit. A nonconductive waterproof flexible cover member is secured to the baseplate and covers the elastomeric pad with the insulated conductors passing through the cover member. The cover member is capable of immediately transmitting the swimmer's externally applied pressure to the elastomeric pad for rendering it conductive and closing the external electrical circuit.

14 Claims, 4 Drawing Figures

FIG. 1
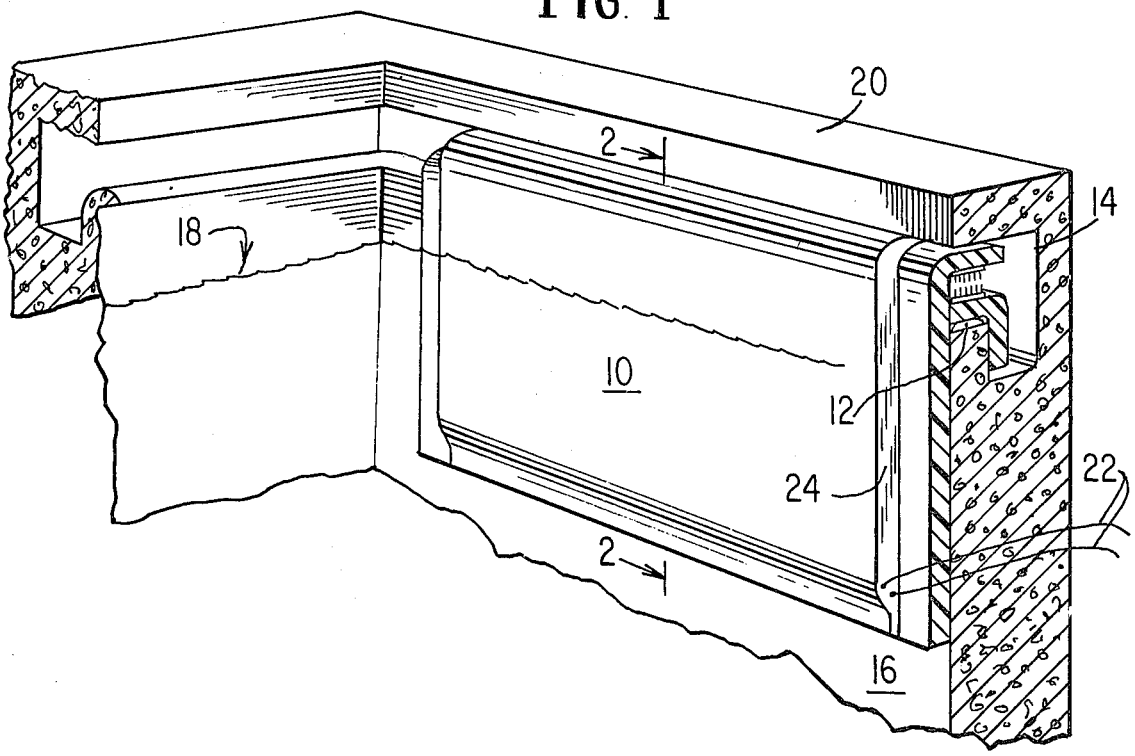
FIG. 4
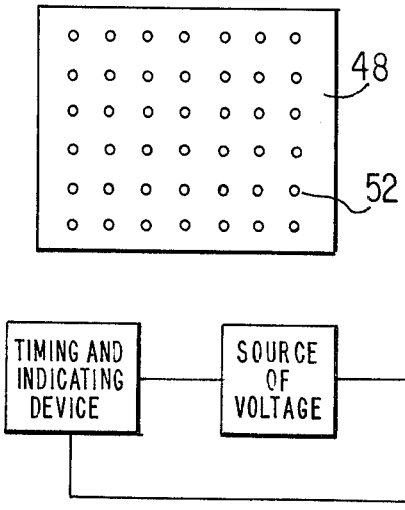
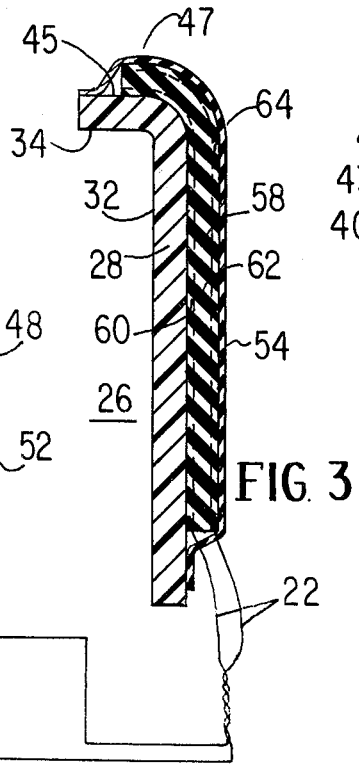
FIG. 3
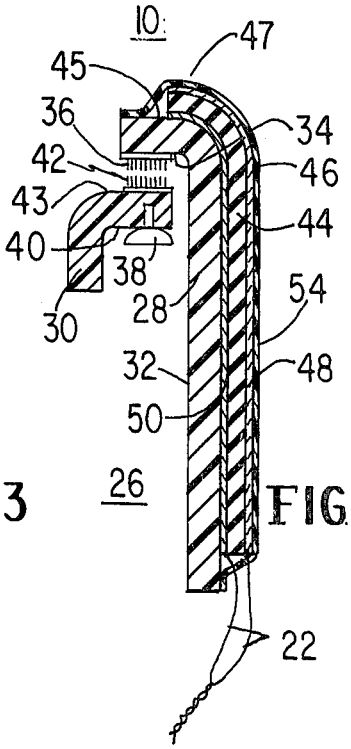
FIG. 2

SWIMMING POOL TOUCH PAD

BACKGROUND OF THE INVENTION

This application is related to electrical switching apparatus and more particularly to sealed and insulated pressure actuated switching apparatus for use in swimming pools or the like to provide signals for race initiation and termination.

Electrical switching apparatus are employed in swimming races in order to start and/or stop the timing clock at the end of the race. These apparatus are generally pressure sensitive electrical switches which are secured to the side wall of the swimming pool. When pressure is applied to these switches by the swimmer, they will actuate providing an electrical current path to a clock or other timing device for controlling the clock and timing the race. These devices are more commonly known to swimming enthusiasts as swimming pool touch pads.

A touch pad presently being used consists of a pair of rectangular stainless steel screen-like elements separated by a very soft rubber sponge-like material, all encased in an insulated sheath with wires extending from the screen-like material. Pressure applied to one element through the insulated sheath will cause it to compress the sponge-like material until portions of that element extend through the openings in the sponge-like material and make positive contact at some point on the screen with the second screen-like element. In this touch pad, the sponge-like material deteriorates readily so that the touch pad is susceptible to a continuous shorting condition between the two screens after it has been used for an extended period of time. The density of the sponge-like material varies greatly as does its thickness so that prior to the degradation of this sponge-like material the difference in pressures necessary to force one element through the openings in the sponge-like material and against the other element causes different ones of this particular type of touch pad to have different sensitivities. Some are so insensitive that swimmers cannot put enough pressure on them in a normal manner to cause switching and conductivity and stop the timing clock. Also, the foam is in an air filled area that is always susceptible to leaks, resulting in shorting and contamination.

A second type of touch pad being used employs multiple aluminum plates pivotally secured by a pivot and hinges along the edge extending deepest into a swimming pool and slightly separated at the upper edge extending out of the pool. A microswitch is positioned adjacent the top edge and is actuated when pressure is applied to the outer plate by the swimmer causing it to pivot towards the inner plate and contact the microswitch. This apparatus is subject to deterioration due to corrosion of the pivot and hinges, and corrosion of the aluminum panels and microswitch. Again, as with the previously described touch pad, the most serious problem is insensitivity to pressure, resulting from the weight of the panels and the above noted corrosion inhibiting pivoting of the plates, so that a swimmer cannot actuate the touch pad; and relatively short useful life of the apparatus due to degradation. Due to the three dimensional nature of this construction, and the use of unprotected aluminum extruded sections, the swimmer runs a high risk of being cut or scraped during turns and finishes.

Neither style has the ability to be bent and still operate properly — i.e., be sensitive on the top and on the front — rather, with these alternate types, alternate means must be employed, such as ribbon switches, or more of the same construction in a parallel or perpendicular arrangement. These modifications increase the cost of the device.

SUMMARY OF THE INVENTION

In practicing this invention, a swimming pool touch pad is provided which includes a nonconductive baseplate adapted to be mounted on a swimming pool wall. A normally nonconductive generally planar pressure sensitive elastomeric pad having front and rear surfaces is positioned on the baseplate and is adapted to become selectively conductive upon application of pressure to the front surface providing an electrical current path transversely through the elastomeric pad from the front to the rear surface. Conductive means secured to the elastomeric pad front and rear surfaces extend exterior to the touch pad and provide the connection to an external electrical current. A nonconductive waterproof flexible cover member is secured to the baseplate and encloses the elastomeric pad with the conductive means passing through the cover member. The cover member is capable of immediately transmitting externally applied pressure to the elastomeric pad to render the elastomeric pad conductive for closing the external electrical circuit to which the conductive means may be connected.

BRIEF DESCRIPTION OF THE DRAWINGS

FIG. 1 is a fragmentary perspective view with parts shown in section of the corner of a swimming pool having a touch pad of the invention mounted to an end wall of said swimming pool;

FIG. 2 is a sectional view of the touch pad of FIG. 1 taken generally along the line 2—2 and in the direction indicated;

FIG. 3 is a section view similar to that of FIG. 2 but illustrating another embodiment of the touch pad of the invention; and FIG. 4 is a plan view of a part of the touch pad of FIG. 1.

DETAILED DESCRIPTION OF THE PREFERRED EMBODIMENTS

Referring to FIG. 1, there is shown a swimming pool touch pad of this invention identified generally by the numeral 10. Touch pad 10 is shown seated on edge 12 of gutter 14 and bearing against swimming pool wall 16. In the preferred embodiment touch pad 10 has a vertical dimension from its point of engagement with the edge 12 measured downwardly of approximately 2 feet. This dimension enables touch pad 10 to extend to a depth sufficiently below the surface of the water 18 to insure contact with the pad by a swimmer. If desired, touch pad 10 can be seated on top edge 20 of the swimming pool instead of edge 12 of pool gutter 14, or it may be seated over the top of the starting block, (not shown) to implement starting the clock. The 2-foot dimension of pad 10 allows the touch pad to extend sufficiently into the water 18 for contact by a swimmer when secured to the gutter edge 12, or may be higher for securing to the top edge 20 or the starting block. Touch pad 10 has a width in the horizontal dimension of approximately 4 to 8 feet so that it extends the full width of the racing lane in a swimming pool.

A pair of insulated waterproof electrical conductors 22 is shown extending from the side edge 24 of pad 10. One end of each conductor is connected to a transducer such as a clock or other similar timing device (not shown) and the other end of each conductor is connected to a normally nonconductive member within pad 10 so that an open circuit exists between pad 10 and the timing device. When touch pad 10 is pressed the member within pad 10 will become conductive forming an electrical closed circuit so that pad 10 and conductors 22 can conduct a termination signal to the clock for stopping its operation.

Referring now to FIGS. 1 and 2, touch pad 10 includes a baseplate 26 which includes two sections 28 and 30. Section 28 is in the form of an inverted, reversed L with the vertical portion extending substantially perpendicular to the horizontal portion. Section 28 is formed from a nonconductive plastic material such as, for example, polystyrene or polyvinylchloride (PVC). In the preferred embodiment, section 28 is approximately three-sixteenths inch thich and has a rectangular shape with dimensions of approximately 2 feet by 6 feet. The back surface 32 of section 28 is adapted to bear against wall 16 of the swimming pool. The bottom surface 34 of the horizontal portion of section 28 has one-half of an attachment device 36 secured thereto. The attachment device 36 is a device which when mated with a companion attachment device will tenaciously adhere to the companion attachment device. A device marketed and sold under the name VELCRO can be used for the device 36 and its companion attachment device.

Section 30 of baseplate 26 is an angular shaped member which is formed by bending a flat strip into two legs extending substantially perpendicular to one another. Section 30 is formed from either the same material as section 28 or from a metal such as stainless steel. Suction cups 38 are shown secured to the bottom surface 40 of one leg of section 30 and the companion attachment device 42 for attachment device 36 is secured to the top surface 43 of the same leg of section 30. As one embodiment, section 30 can consist of two pieces, formed as described above, with each approximately six inches wide.

A normally electrically nonconductive pressure sensitive elastomeric pad 44 is positioned on the front surface 46 of base plate 26. Pad 46 has a generally planar rectangular configuration and is only very slightly smaller than section 28 in width. A lip portion 47 extends onto top surface 45 of the horizontal portion of Section 28. For definition purposes the term generally planar includes lip portion 47. Elastomeric member 44 is preferably approximately one-thirtyseconds inch thick although other thicknesses may be employed and is formed from material such as silicon rubber which has been doped with a suitable conduction-inducing compound during the processing. The processing technique results in an elastomeric pad 44 which, upon application of pressure, will change from the above noted normally electrically nonconductive state to an electrically conductive state in the area of application of the pressure. In this case, pad 44 upon application of pressure by the hand of a swimmer will break down and provide an electrical current conductive path transversely through pad 46 from its front planar surface to its rear planar surface in the area of application of the pressure.

Accordingly an electrical open circuit normally exists transversely across pad 46 from the front to its rear surface which becomes an electrical closed circuit when pressure is applied, in the area of the applied pressure. It is understood, of course, that the pressure to be applied must be greater than that caused by the water 18 bearing against pad 44. Furthermore, pad 44 must be manufactured such that it will break down and conduct current immediately upon application of sufficient pressure, so that contact by a swimmer will result in the desired instantaneous conductive current path through pad 44.

In order to provide an electrical connection to the area of pressure, a first electrode 48 is secured to the front planar surface of elastomeric pad 44 and is preferably secured to the underside of the protective cover 54, and a second electrode 50 is secured to the back planar surface of elastomeric pad 44 and is preferably secured to the base plate surface 45. Electrodes 48 and 50 are in the form of foil sheets approximately 0.001 inches thick extending over the entire front and rear planar surfaces of elastomeric pad 44. They preferably are highly electrically conductive members such as copper, although stainless steel foil may be employed because of its good electrical conductivity and relative imperviousness to corrosion due to moisture. Electrodes 48 and 50 are secured to elastomeric pad 44 via a plurality of glue dots 52 shown in greater detail in FIG. 4. The glue dots 52 are approximately one-fourth inch in diameter and are arranged in a regular manner. The glue employed to hold electrodes 48 and 50 to elastomeric pad 44 typically is nonconductive. In order to prevent insulating the foil from the elastomer with a film of glue, a dot matrix is formed with the gluing dots on electrode 48 axially aligned with the centers of the gluing dots of electrode 50, to allow an electrical path through glueless areas. The dots are small and widely spaced so that any hand pressure applied to pad 44 will result in a conductive current path through pad 44. One each of the pair of insulated wires 22 are connected at one end to electrodes 48 and 50. The other end of each conductor is connected to the clock to be operated.

An electrically nonconductive, waterproof flexible cover member 54 is secured to section 28 of baseplate 26 at all points along the side and bottom edges of front surface 46 and along top surface 45 by a water insoluble glue or by any other process well known in the art, and to the outer surface of electrode 48. cover member 54 completely encloses electrodes 48 and 50 and pad 44. The pair of insulated waterproof conductors 22 pass through cover member 54 and are sealed, by any one of a number of well known sealing techniques, to the member 54 at the point of passage therethrough in order to prevent the entry of water 18 into the pocket formed by cover 54 and section 28 of baseplate 26. Cover member 54 is preferably a vinyl plastic member having a thickness of 10 mils or more, sufficient to prevent easy tearing of member 54, yet elastic enough to allow the passage of pressure therethrough from the outside environment to pad 44. The outer surface of cover member 54 is preferably a mat or roughened finish in order to provide a positive gripping surface for the swimmer's hands or feet. This is particularly important if the touch pad 10 is to be used in a race involving more than one lap. The mat or non-skid outer surface on cover member 54 is necessary in order to prevent the swimmer's hands and feet from slipping while he is attempting to make his turn at the wall 16 on which touch pad 10 is placed. The cover member 54 is capable of immediately transmitting externally applied pressure, such as can be applied by a swimmer, to elastomeric pad 44 for rendering pad 44 electrically conductive so that an electrical signal can pass through pad 44, electrodes 46 and 48 and conductors 22 to the clock for controlling the clock.

While the use of electrodes 48 and 50 glued to elastomeric pad 44 are a workable embodiment, an alternate construction shown in FIG. 3 offers reduced assembly costs. In the embodiment shown in FIG. 3 elements which are the same as those shown in FIG. 2 are given identical reference numbers. Referring to FIG. 3, electrodes 48 and 50 and elastomeric pad 44 have been replaced with a singularly formed elastomeric member 58. Elastomeric member 58 consists of three sections identified as 60, 62 and 64 respectively which are shown in FIG. 3 via the dotted lines in member 58. All three sections are formed from the same material, in the preferred embodiment silicon rubber, and are doped with a compound. Section 62 is identical to elastomeric pad 44 in that it is normally electrically nonconductive but will become electrically conductive on the area of application of a sufficient pressure. Sections 60 and 64 are identical in function to electrodes 48 and 50 and are formed by more highly doping the top and bottom surfaces of section 58. The material employed for elastomeric pad 44 and sections 60, 62 and 64 of member 58 is available commercially under the trade designation Dynacon by Dynacon Industries, Inc. of Leonia, N.J.

In both embodiments the voltage supplied to conductors 22 is typically less than five volts DC. The resistance measured across conductors 22 varies from more than a megohn when no pressure is applied to less than 100 ohms when pressure is applied. Should cover 54 tear allowing water to enter the resistance measured across conductors 22 would be in excess of one thousand ohms. As the clock type transducers employed respond to currents in circuits under 1,000 ohms and generally under 100 ohms the resistance across conductors 22 when water has passed through cover member 54 will not actuate the transducer. Furthermore, the transducers employed use such low voltages that there is no danger of injury or shock to a swimmer as a result of a continuing current through pad 10 when cover member 54 is torn.

It will be appreciated that considerable variation is capable of being made in the details of this invention without departing from the spirit or scope of the invention as defined in the appended claims.

What is claimed and desired to secure by Letters Patent of the United States is:

1. A swimming pool touch pad including in combination:

a nonconductive baseplate adapted to be mounted on a swimming pool wall, a normally nonconductive generally planar pressure sensitive elastomeric pad having front and rear surfaces positioned on said baseplate and adapted to become selectively conductive upon application of pressure to the front surface thereof to provide an electrical current path therethrough in the area of such application and transversely through the pad between the front and rear surfaces, conductive means coupled to the respective surfaces of said elastomeric pad and extending to the exterior of said touch pad to provide connection to an external electrical circuit, a nonconductive waterproof, flexible cover member secured to said baseplate and enclosing said pad, the conductive means being passed through said cover member, said cover member being capable of immediately transmitting externally applied pressure to said elastomeric pad to render same conductive for closing the external electrical circuit to which said conductive means may be connected.

2. The swimming pool touch pad of claim 1 wherein said elastomeric pad front surface is positioned adjacent said cover member, and said rear surface is positioned adjacent said baseplate, said conductive means including a first electrode positioned against said rear surface and a second electrode positioned against said front surface and conductor means coupled to said electrodes and extending to the exterior of said touch pad to provide the connection to said external electrical circuit.

3. The swimming pool touch pad of claim 2 wherein said first and second electrodes are electrically conductive sheets extending over the entire area of said front and rear surfaces for providing said connection to said external electrical circuit over the entire area.

4. The swimming pool touch pad of claim 3 wherein said sheets are secured to said front and rear suurfaces at a plurality of locations.

5. The swimming pool touch pad of claim 4 wherein said first sheet is secured to said rear surface at a plurality of first locations and said second sheet is secured to said front surface at a plurality of second locations, said first and second locations being aligned to prevent incomplete conductive paths through said pad.

6. The swimming pool touch pad of claim 1 wherein said pad is formed from silicone rubber doped with an element to provide an electrical current path therethrough from said front to rear surface upon application of said pressure.

7. The swimming pool touch pad of claim 1 wherein said elastomeric pad includes a center layer sandwiched between a front and a rear outer layer with said outer layers being electrically conductive whereby each of said outer layers forms an electrode, said center layer being adapted to become selectively conductive upon application of pressure to the front surface thereof to provide an electrical current path therethrough in the area of such application and transversely through the pad between said outer layers.

8. The swimming pool touch pad of claim 7 wherein said layers are formed from silicone rubber, said center layer being doped with an element such that said center layer becomes conductive upon application of said pressure, said outer layers being doped with an electrically conductive element to be normally electrically conductive whereby each forms said electrode.

9. The swimming pool touch pad of claim 1 wherein said baseplate has a first planar section having a front surface for mounting said elastomeric pad and cover member and a rear surface adapted to seat against the swimming pool wall, and a second section extending from an edge of said first section substantially perpendicular to said first section for mounting said touch pad to one of the pool edge and pool gutter.

10. The swimming pool touch pad of claim 9 wherein said second section includes a first portion secured to said first section and having an attachment means thereon, and a second angular shaped portion for extending over one of said pool edge and pool gutter, said second portion having attachment means thereon for mating with said first portion attachment means whereby said swimming pool pad is secured to one of said pool edge and pool gutter.

11. The swimming pool touch pad of claim 10 wherein said second section has suction cups secured thereto for securing said portion to said pool.

12. The swimming pool touch pad of claim 1 wherein said cover member has a nonskid outer surface and is formed from a plastic.

13. In a swimming race electronic control system the combination including:

transducer means comprising;

a source of supply voltage, and circuit means for indicating race completion, a swimming pool touch pad comprising;

a nonconductive baseplate adapted to be mounted on a swimming pool wall, a normally nonconductive generally planar pressure sensitive elastomeric pad positioned on said baseplate and adapted to become selectively conductive upon application of pressure to the front surface thereof to provide an electrical current path therethrough in the area of such application and transversely through the pad between the front and rear surfaces, conductive means coupled to the respective surfaces of said elastomeric pad and to said transducer means for providing an electrical connection therebetween, and a nonconductive waterproof flexible cover member secured to said baseplate and enclosing said pad, the conductive means being passed through said cover member, said cover member being capable of immediately transmitting externally applied pressure to said elastomeric pad to render same conductive whereby an electrical current path is provided from said source of supply voltage through said conductive means and elastomeric pad to said circuit means for controlling same.

14. A swimming pool touch pad including in combination;

a nonconductive plastic baseplate having a first planar section with a front surface and a rear surface adapted to seat against the swimming pool wall, and a second section extending from an edge of said first section substantially perpendicular to said first section for mounting said touch pad on said swimming pool wall, a normally nonconductive generally planar pressure sensitive elastomeric pad having front and rear surfaces positioned on said baseplate first section and extending onto said baseplate second section, said elastomeric pad being adapted to become selectively conductive upon application of pressure to the front surface thereof to provide an electrical current path therethrough in the area of said application and transversely through the elastomeric pad between the front and rear surfaces, first and second electrodes secured to said front and rear surfaces respectively and extending over the entire area thereof, and preferably bonded to the baseplate and the undersurface of the protective cover, first and second insulated, waterproof conductors secured to said first and second electrodes respectively and extending to the exterior of said touch pad to provide connection to an external electric circuit, and a nonconductive waterproof flexible plastic cover member secured to said baseplate first and second sections and enclosing, said elastomeric pad with the first and second conductors passing through the cover member with said cover member sealed at the pass through point, said cover member being capable of immediately transmitting externally applied pressure to said elastomeric pad to render same conductive for closing the external electrical circuit to which said first and second conductors may be connected.

* * * * *